US006202966B1

(12) United States Patent
MacDonald et al.

(10) Patent No.: US 6,202,966 B1
(45) **Date of Patent: *Mar. 20, 2001**

(54) UNIVERSAL CANTILEVER SUPPORT BRACKET

(75) Inventors: Douglas B. MacDonald, Caledonia; Robert J. Hoeft, Pinckney, both of MI (US)

(73) Assignee: Steelcase Development Inc., Grand Rapids, MI (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/060,915

(22) Filed: Apr. 15, 1998

(51) Int. Cl.[7] ..... A47G 29/02; E04G 3/08; E06B 7/28

(52) U.S. Cl. ..... 248/243; 248/247

(58) Field of Search ..... 248/243, 247, 248/250, 558, 221.12, 221.11, 222.51, 220.43, 220.41, 225.21, 301; 211/90.02, 90.01; 108/108, 110, 64, 106, 102; 52/715, 712, 36.4, 36.5, 73

(56) References Cited

U.S. PATENT DOCUMENTS

| | | | | |
|---|---|---|---|---|
| 224,863 | | 2/1880 | Blessing | 248/241 |
| 723,677 | | 3/1903 | Kade | 248/245 |
| 2,576,865 | * | 11/1951 | Vanderveld | 248/243 |
| 2,691,502 | | 10/1954 | Jones | 248/243 |
| 2,741,449 | | 4/1956 | Heselov | 248/243 |
| 3,097,822 | | 7/1963 | Attwood | 248/250 |
| 3,199,822 | | 8/1965 | Ruhnke | 248/243 |
| 3,290,846 | | 12/1966 | Mader et al. | 52/479 |
| 3,534,952 | | 10/1970 | Comer | 248/243 |
| 3,737,131 | * | 6/1973 | Larson | 248/220.41 |
| 3,841,195 | * | 10/1974 | Jureit | 52/715 X |
| 4,198,913 | | 4/1980 | Haworth et al. | 108/108 |
| 4,428,172 | * | 1/1984 | Larsson | 248/243 X |
| 4,660,477 | | 4/1987 | Kortering et al. | 108/108 |
| 4,720,069 | | 1/1988 | Bessinger | 248/250 |
| 4,836,484 | * | 6/1989 | Reed | 248/243 |
| 4,938,442 | | 7/1990 | Mastrodicasa | 248/250 |
| 5,185,971 | * | 2/1993 | Johnson, Jr. | 248/243 X |
| 5,205,421 | | 4/1993 | Bustos | 211/59.2 |
| 5,405,114 | | 4/1995 | Dias | 248/250 |
| 5,437,426 | | 8/1995 | MacDonald | 248/222.13 |

* cited by examiner

*Primary Examiner*—Anita M. King
*Assistant Examiner*—Jerome DeLuca
(74) *Attorney, Agent, or Firm*—Price, Heneveld, Cooper, DeWitt & Litton

(57) ABSTRACT

A multi-position bracket includes a cantilever body defining first and second sides, and including rear and upper orthogonal edges. The rear edge includes at least one hook shaped to removably engage slots of an upright. The multi-position bracket further includes a mounting plate interconnected with the cantilever body in a selected one of first and second offset positions and a center position relative to the cantilever body. The mounting plate defines a center portion and first and second opposite side portions. The center portion of the mounting plate includes a center connector interconnecting the mounting plate in the cantilever body with the mounting plate in the center position for supporting adjacent side edges of a pair of side-by-side hang-on furniture units. The first side portion of the mounting plate includes a connector interconnecting the mounting plate and the cantilever body with the mounting plate offset to the first side of the cantilever body for supporting a side edge of a hang-on furniture unit disposed on the first side of the cantilever body. The second side portion of the mounting plate includes a connector interconnecting the mounting plate and the cantilever body with the mounting plate offset to the second side of the cantilever body for supporting a side edge of a hang-on furniture unit disposed on the second side of the cantilever body.

26 Claims, 5 Drawing Sheets

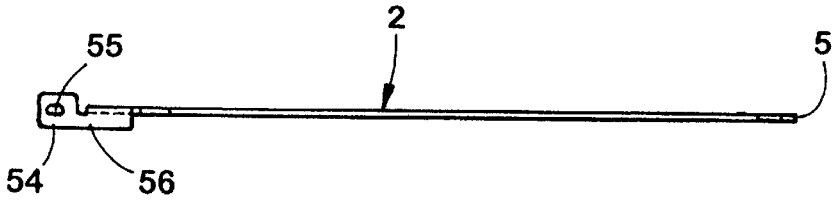
Fig. 14
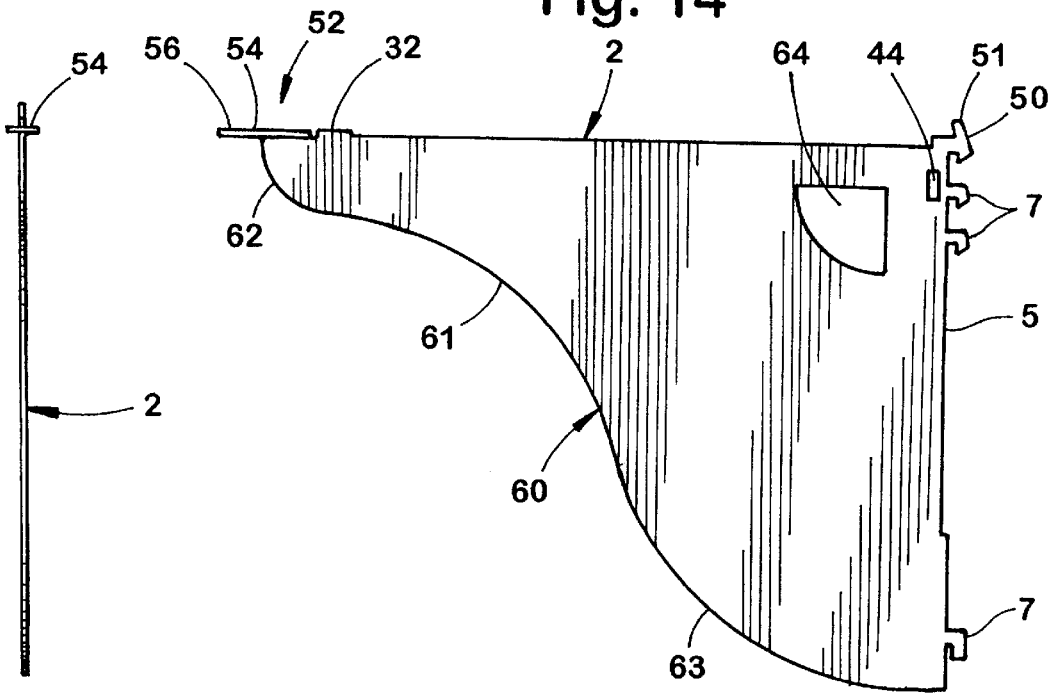
Fig. 12
Fig. 13

UNIVERSAL CANTILEVER SUPPORT BRACKET

CROSS-REFERENCES TO RELATED APPLICATIONS

The present application is related to commonly assigned, co-pending U.S. patent application Ser. No. 08/914,664, filed Aug. 19, 1997, entitled "KNOCK-DOWN PORTABLE PARTITION SYSTEM", and also related to commonly assigned, co-pending U.S. patent application Ser. No. 08/856,995, filed May 15, 1997, entitled "KNOCK-DOWN PORTABLE PARTITION SYSTEM", each of which is hereby incorporated by reference.

BACKGROUND OF THE INVENTION

The present invention relates to office furniture, and in particular to a multi-position bracket for hang-on furniture units and the like, that can support adjacent side edges of side-by-side hang-on furniture units, or a side edge of a hang-on furniture unit disposed on either side of the bracket.

In partition panel systems and the like, worksurfaces, shelves, and other hang-on furniture units are often supported by brackets that releasably attach to slots in upright structural members of the partition panels. Worksurfaces and the like are commonly supported along opposite side edges, requiring a left-hand bracket for one side edge, and a right-hand bracket for the other side edge. Furthermore, if a pair of hang-on furniture units or worksurfaces are arranged end-to-end, a center bracket is required to support the adjacent side edges of the hang-on furniture units. Accordingly, at least three bracket configurations are used to support hang-on furniture units in the configurations discussed above, leading to excessive cost of tooling and manufacture, as well as inventory related expenses.

Thus, a multi-position bracket for supporting hang-on furniture units is desired solving the aforementioned problems.

SUMMARY OF THE INVENTION

One aspect of the present invention is a multi-position bracket for supporting hang-on furniture units on a slotted upright. The multi-position bracket includes a cantilever body defining first and second sides, and including rear and upper orthogonal edges. The rear edge includes at least one hook shaped to removably engage slots of an upright. The multi-position bracket further includes a mounting plate interconnected with the cantilever body in a selected one of first and second offset positions and a center position relative to the cantilever body. The mounting plate defines a center portion and first and second opposite side portions. The center portion of the mounting plate includes a center connector interconnecting the mounting plate to the cantilever body with the mounting plate in the center position for supporting adjacent side edges of a pair of side-by-side hang-on furniture units. The first side portion of the mounting plate includes a connector interconnecting the mounting plate and the cantilever body with the mounting plate offset to the first side of the cantilever body for supporting a side edge of a hang-on furniture unit disposed on the first side of the cantilever body. The second side portion of the mounting plate includes a connector interconnecting the mounting plate and the cantilever body with the mounting plate offset to the second side of the cantilever body for supporting a side edge of a hang-on furniture unit disposed on the second side of the cantilever body.

Another aspect of the present invention is a kit for hang-on partition worksurfaces including at least one worksurface and a multi-position bracket. The multi-position bracket includes a cantilever body defining opposite sides and including rear and upper orthogonal edges. The multi-position bracket also includes a mounting plate configured to be secured to the worksurface and including at least two connectors adapted to interconnect the mounting plate with the cantilever body. A first one of the connectors is adapted to connect the mounting plate to the cantilever body with the mounting plate in a center position for supporting adjacent side edges of a pair of side-by-side ones of the worksurfaces. A second one of the connectors is adapted to interconnect the mounting plate with the cantilever body, wherein the mounting plate is offset to a selected opposite side of the cantilever body for supporting a side edge of the worksurface.

Yet another aspect of the present invention is a mounting plate for hang-on furniture units including a plate having at least three side-by-side apertures adjacent a front portion of the plate. Each aperture is engagable with a tab of a cantilever body to permit support of the front portion of the plate in a selected one of three positions corresponding to the apertures. The plate also has at least three hooks adjacent a rear portion of the plate. Each hook is engagable with an opening of the cantilever body to permit support of the rear portion of the plate in a selected one of three positions corresponding to the hooks.

The principle objects of the present invention are to provide a multi-position bracket that can be used to support either side edge of a hang-on furniture unit, or adjacent side edges of a pair of side-by-side hang-on furniture units. The multi-position bracket is easily fabricated, and facilitates installation of the hang-on furniture units.

These and other features, advantages and objects of the present invention will be further understood and appreciated by those skilled in the art by reference to the following specification, claims and appended drawings.

BRIEF DESCRIPTION OF THE DRAWINGS

FIG. 12 is a side elevational view of the cantilever body;

FIG. 13 is a front elevational view of the cantilever body; and

FIG. 14 is a top view of the cantilever body.

DETAILED DESCRIPTION OF PREFERRED EMBODIMENT

Figure 1:
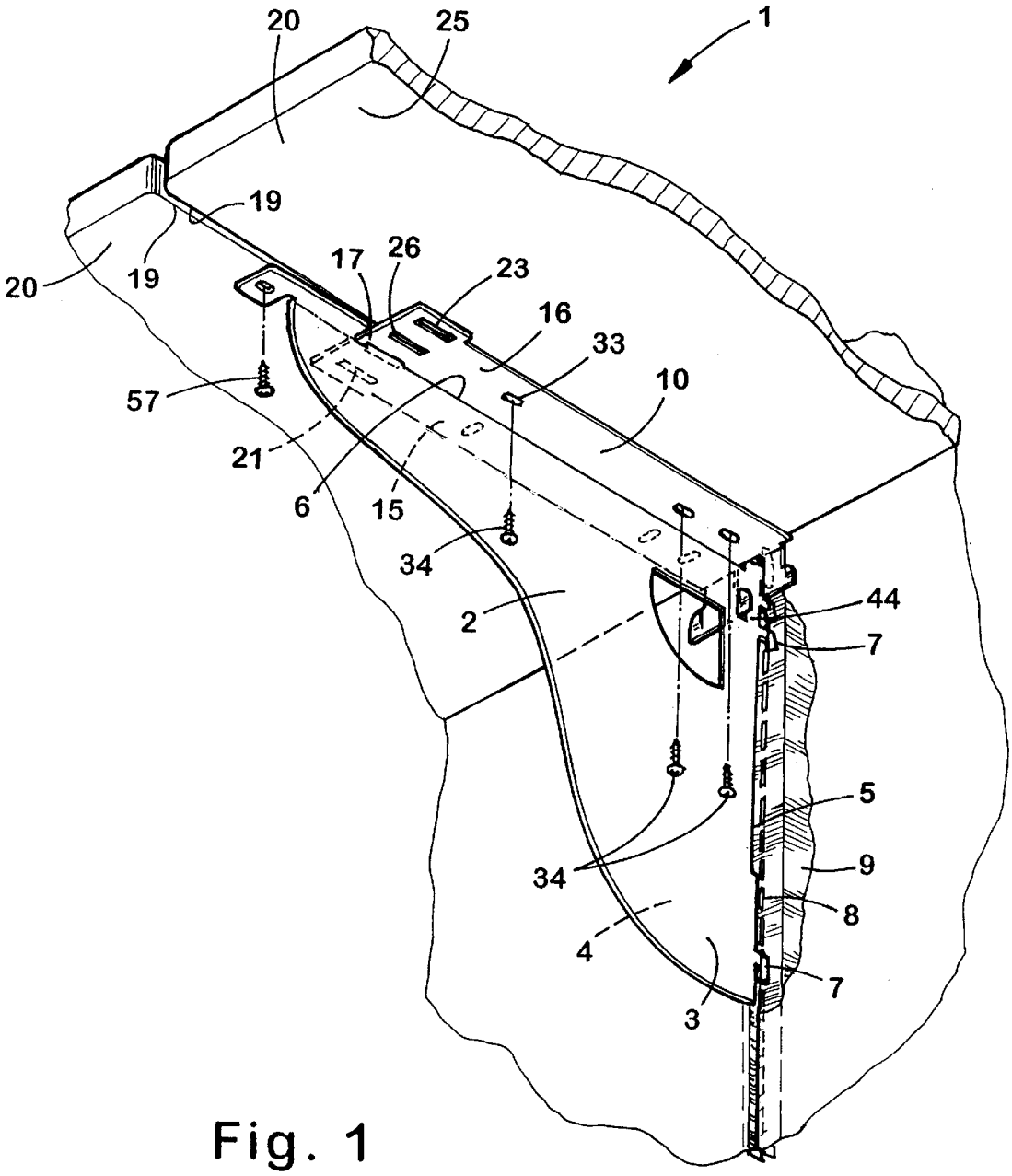
FIG. 1 is a fragmentary, perspective view of a multi-position bracket embodying the present invention, comprising a cantilever body and a mounting plate.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
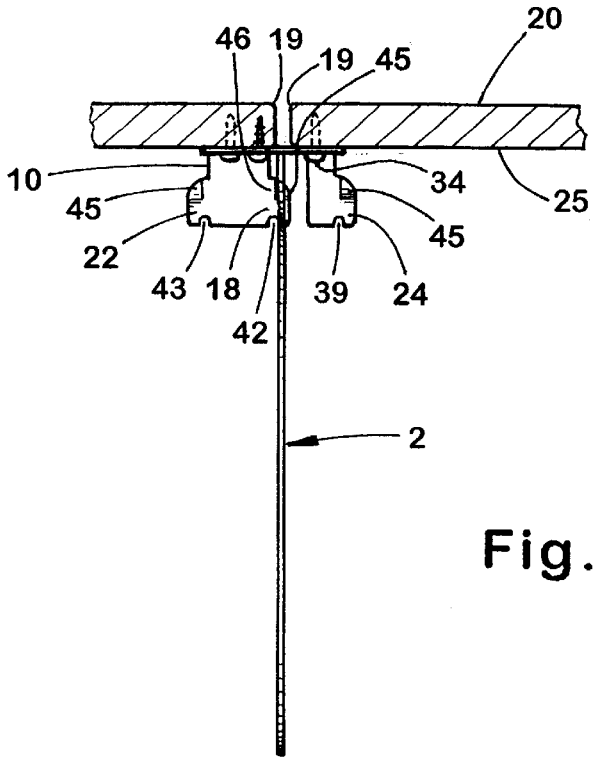
FIG. 2 is a fragmentary, side elevational view of the multi-position bracket.

The reference numeral 1 (FIG. 1) generally designates a multi-position bracket embodying the present invention, which is particularly designed for supporting hang-on furniture units and the like in open office plans, and other similar settings and environments. In the illustrated example, multi-position bracket 1 includes a cantilever body 2 defining first and second sides 3, 4. The cantilever body 2 includes rear and upper orthogonal edges 5, 6. The rear edge 5 includes at least one hook 7 shaped to removably engage slots 8 of an upright 9. A mounting plate 10 is interconnected with the cantilever body 2 in a selected one of a first offset position 11 (FIG. 4), a second offset position 12 (FIG. 7), and a center position 13 (FIGS. 5, 6) relative to the cantilever body 2. The mounting plate defines a center portion 14, and first and second opposite side portions 15, 16. The center portion 14 of the mounting plate 10 includes a center connector such as center slots 17, 26 and center support hook 18 (FIG. 2) interconnecting the mounting plate 10 and the cantilever body 2 with the mounting plate 10 in the center position 13 for supporting adjacent side edges of a pair of side-by-side hang-on furniture units, such as worksurfaces 20 (FIG. 1). The first side portion 15 (FIG. 4) includes a connector such as a first side slot 21 and first side support hook 22 interconnecting the mounting plate 10 and the cantilever body 2 with the mounting plate 10 offset to the first side 3 of the cantilever body 2 for supporting a side edge 19 of a hang-on furniture unit such as a worksurface 20 disposed on the first side 3 of the cantilever body 2. The second side portion 16 (FIG. 7) includes a connector such as a second side slot 23 and a second side support hook 24 interconnecting the mounting plate 10 and the cantilever body 2 with the mounting plate 10 offset to the second side 4 of the cantilever body 2 for supporting a side edge 19 of a hang-on furniture unit such as a worksurface 20 disposed on the second side 4 of the cantilever body 2.

Figure 4:
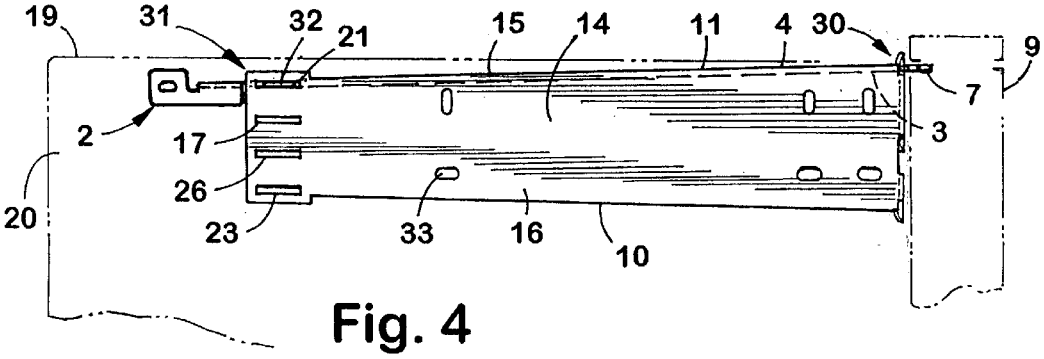
FIG. 4 is a section view taken along the line IV—IV, FIG. 3, showing the mounting plate offset to a first side.
Figure 5:
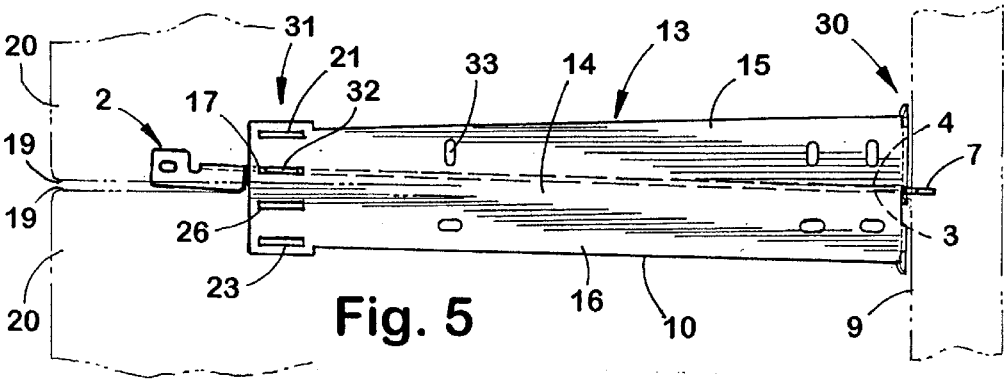
FIG. 5 is a top view of the multi-position bracket comparable to FIG. 4, but with the cantilever body engaging a slot in the center portion of the mounting plate for support of a pair of side-by-side hang-on furniture units.
Figure 6:
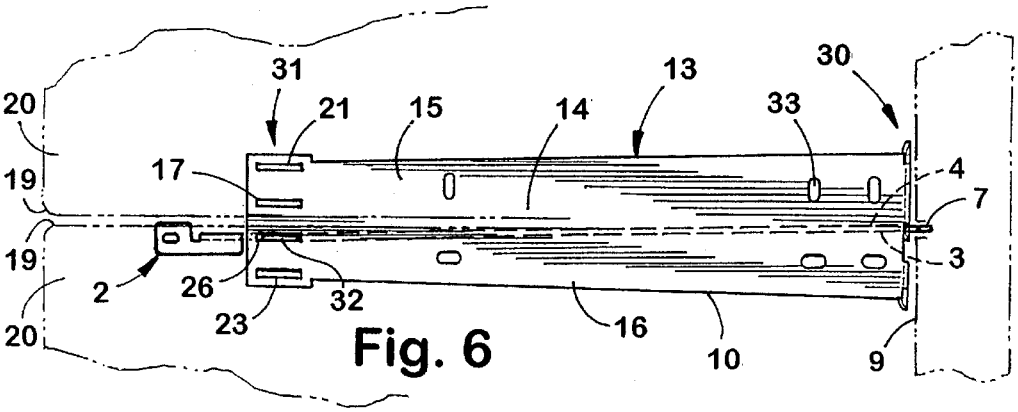
FIG. 6 is a top view of the multi-position bracket with the cantilever body engaging a slot in the center portion of the mounting plate for support of a pair of side-by-side hang-on furniture units.
Figure 7:
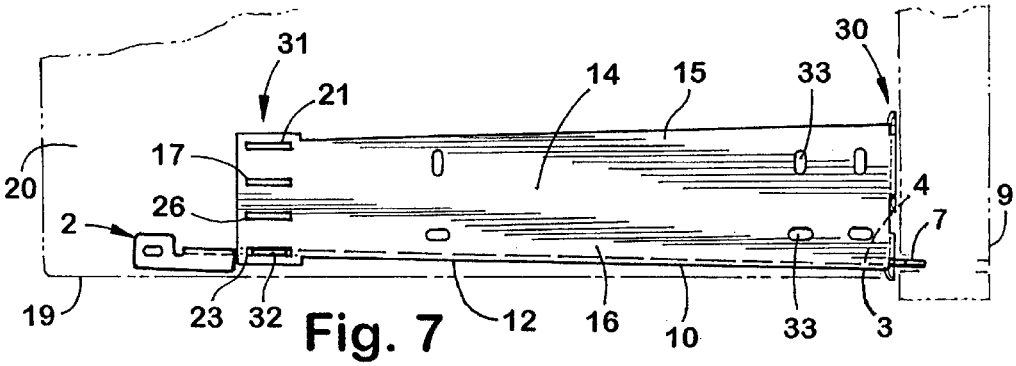
FIG. 7 is a top view of the multi-position bracket with the mounting plate offset to a second side of the cantilever body.
Figure 8:
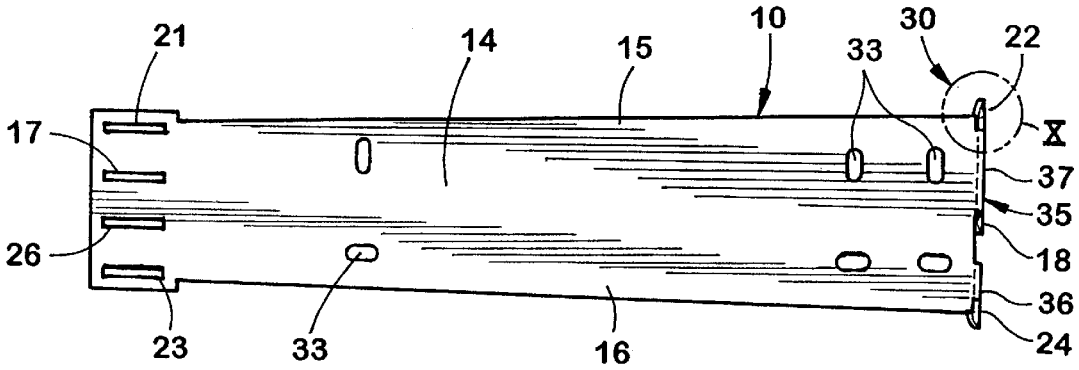
FIG. 8 is a top plan view of the mounting plate.
Figure 9:
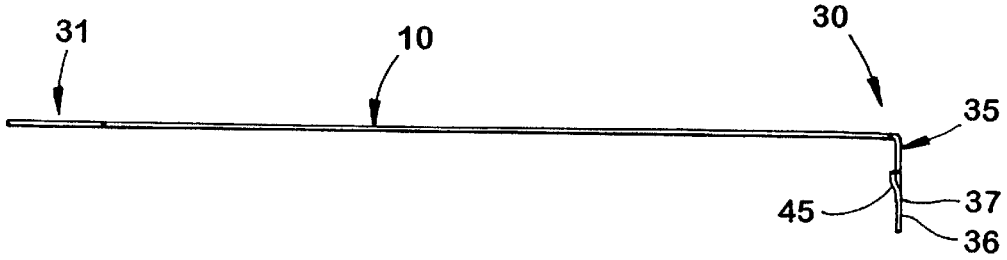
FIG. 9 is a front elevational view of the mounting plate.
Figure 10:
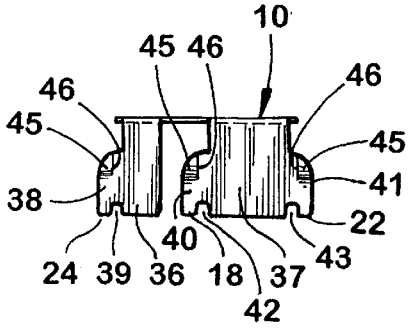
FIG. 10 is a side elevational view of the mounting plate.

With reference to FIG. 4, mounting plate 10 is formed from sheet metal, and includes a rear portion 30 and a forward portion 31. Openings or slots 17, 21, 23 and 26 are located adjacent the forward portion 31, and are configured to engage the tab 32 (FIG. 13) of the cantilever body 2. Slots 17 and 26 support the forward portion 31 of mounting plate 10 in one of two center positions illustrated in FIGS. 5, 6. Either center position can be used to support adjacent side edges of a pair of side-by-side hang-on furniture units. A plurality of clearance holes 33 receive fasteners 34 (FIG. 1) to secure the mounting plate 10 to the lower surface 25 of a worksurface 20. The rear edge 35 of the mounting plate 10 includes orthogonal, downwardly-extending flange portions 36 and 37. Downwardly-extending flange portion 36 includes an offset portion 38 and slot 39 forming hook 24. Downwardly-extending flange portion 37 includes offset portions 40 and 41 with slots 42, 43, forming hooks 18 and 22. As discussed in more detail below, each hook 18, 22 and 24 is configured to engage the slot or opening 44 (FIG. 1) in the cantilever body 2 to support the rear portion 30 of the mounting plate 10 in either a first offset position 11 (FIG. 4), a center position 13 (FIGS. 5, 6), or a second offset position 12 (FIG. 7).

Figure 11:
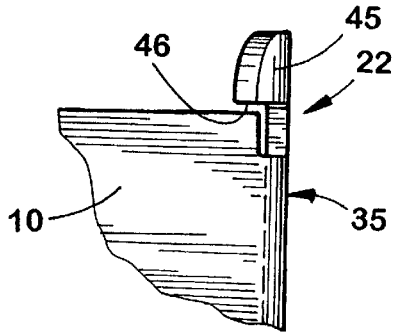
FIG. 11 is a view of the mounting plate of FIG. 8.

With reference to FIG. 11, the upper portion of each hook 18, 22 and 24 includes a bent tab portion 45. During installation, a selected hook 18, 22 or 24 is inserted into the opening 44 of the cantilever body 2, with the forward portion 31 of the mounting plate 10 raised slightly to provide clearance for the tab portion 45. The forward portion 31 of the mounting plate 10 is then rotated downwardly until the desired slot 17, 21, 23 or 26 engages the tab 32 on the cantilever body 2. In this position, the side edge 46 of the tab 45 abuts a side face of the cantilever body 2, thereby counteracting the tendency of the mounting plate 10 to rotate such that the hook disengages the opening 44 during assembly of the bracket 1. When hooks 18 or 24 are inserted into the opening 44, the side edge 46 of the tab 45 will abut the first side 3 of the cantilever body 2. When the first side support book 22 is engaged with the opening 44 in the cantilever body 2, the side edge 46 of the tab 45 will abut the second side 4 of the cantilever body 2.

With reference to FIG. 13, the cantilever body 2 is formed from sheet metal, and includes at least one hook 7 along the rear edge 5 that is shaped to removably support the cantilever body 2 in the slots 8 of an upright partition frame member 9. The upper hook 50 includes an upper extension 51 to prevent accidental dislodgement of the cantilever body 2 from the slots 8 of the upright 9. During installation, the upper hook 50 is first inserted into a slot 8, and the cantilever body 2 is rotated downwardly until the remaining hooks 7 engage slots 8. The cantilever body 2 is then shifted downwardly to engage the hooks 7 in the slots 8. If the cantilever body 2 is inadvertently pushed upwardly, the upper extension 51 of upper hook 50 will abut the upper edge of the slot 8, thereby preventing upward movement and dislodgement of the cantilever body 2. When mounting plate 10 is installed, downwardly extending flange portions 36 and 37 abut the outer surface of upright 9, thereby preventing rotation of cantilever body 2. Furthermore, because the upper edge of extension 51 abuts the upper edge of slot 8, the cantilever body 2 cannot be shifted upwardly to disengage hooks 7 from slots 8. Accordingly, when mounting plate 10 is installed, cantilever body 2 cannot be removed from upright 9.

To remove cantilever body 2 from upright 9, mounting plate 10 is first removed by disengaging tab 32 and hook 18, 22, or 24. Cantilever body 2 is then rotated slightly such that upper hook 50 and the upper hooks 7 shift inward slightly. Upper hook 50 and the uppermost hooks 7 each have a relatively wide slot 49, that, in combination with cut-out portion 48 of rear edge 5, permits the slight rotation of cantilever body 2 and inward shifting of upper hook 50 just described. When upper hook 50 is shifted inwardly, extension 51 no longer abuts the upper edge of slot 8, such that cantilever body 2 can be shifted upwardly slightly until the top edge 47 of hook 50 abuts the upper edge of slot 8. Cantilever body 2 is then rotated to disengage lower hook 7, and further rotated and shifted downwardly to disengage upper hook 50 and the upper two hooks 7.

The forward portion 52 of the cantilever body 2 includes a horizontal support flange 54 having an upper surface 56 that is shaped to abut the lower surface 25 of a worksurface 20 when in the installed position. A clearance hole 55 receives a fastener 57 (FIG. 1) to secure the forward portion 52 of the cantilever body 2 to the worksurface 20. The center slots 17 and 26 of the mounting plate 10 are offset from the central line of the mounting plate 10. Accordingly, the mounting plate 10 may be mounted on the cantilever body 2 in either a first center position (FIG. 5), or a second center position (FIG. 6). This allows the fastener 57 to be secured to either of the adjacent worksurfaces 20. Although the multi-position bracket 1 will support a pair of side-by-side worksurfaces 20 with the mounting plate 10 in either of the two center positions illustrated in FIGS. 5 and 6, it is presently anticipated that the cantilever body 2 will be offset such that the fastener 57 can be secured to the worksurface 20 that is larger, and/or experiences heavier loads.

Figure 3:
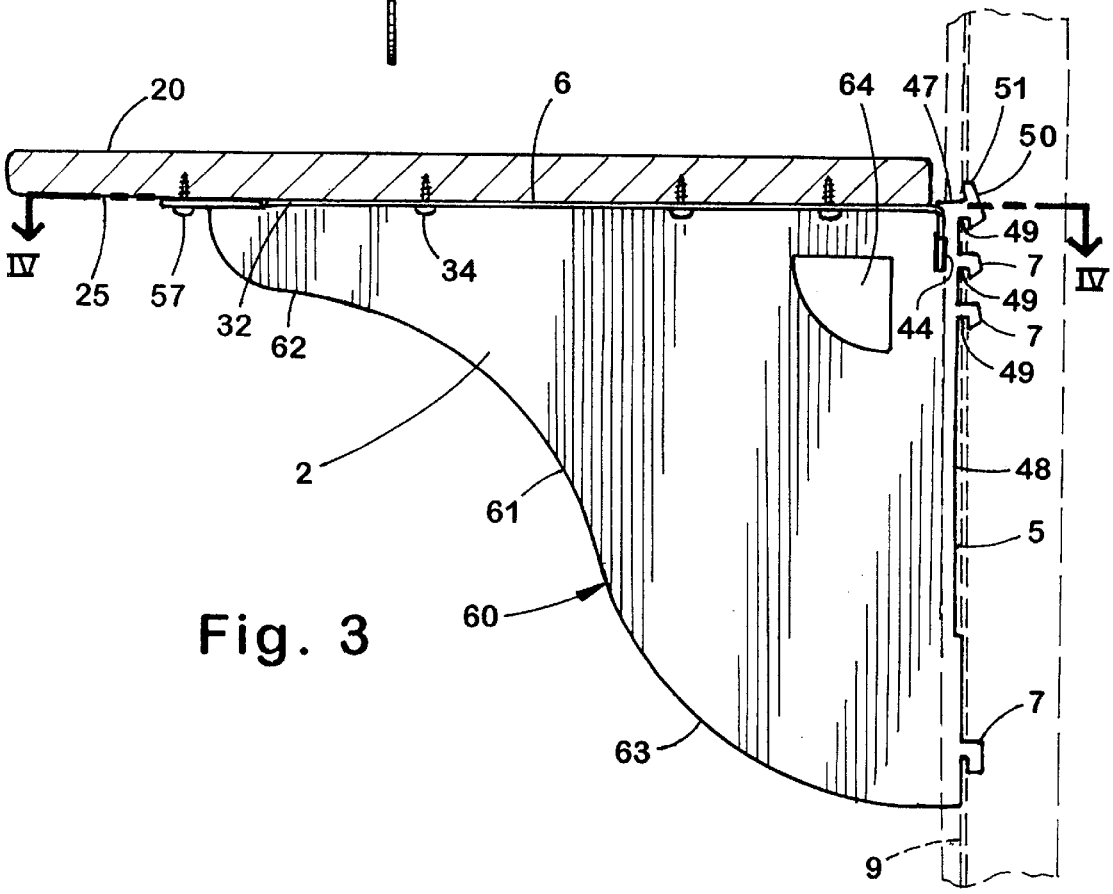
FIG. 3 is a front elevational view of the multi-position bracket.

As discussed above, tab 32 of cantilever body 2 engages a selected one of the slots or openings 17, 21, 23 or 26 to position the mounting plate 10 in a center position (FIGS. 5 and 6), a first offset position (FIG. 4), or a second offset position (FIG. 7). As best seen in FIG. 3, with the worksurface 20 in the installed position, fastener 57 secures the cantilever body 2 to the lower surface 25 of the worksurface 20. In the installed position mounting plate 10 is trapped between the upper edge 6 of cantilever body 2 and lower surface 25 of worksurface 20 such that the tab 32 of the cantilever body 2 cannot be dislodged from the selected slot or opening 17, 21, 23 or 26. Furthermore, as discussed above, slot 39, 42, or 43 and side edge 46 of the tab 45 of the selected hook 18, 22 or 24 engage cantilever body 2, such that the hook cannot be removed from the opening 44 in the cantilever body 2.

With reference to FIG. 13, the forward edge 60 of the cantilever body 2 is smoothly curved, and includes a concave portion 61, and convex portions 62 and 63. A quarter-circular opening 64 provides clearance for pass through wiring if required for a particular application.

During installation of the multi-position bracket 1, the cantilever body 2 is first installed by inserting the upper hook 50 into a slot 8 of upright 9. Cantilever body 2 is shifted upwardly slightly and rotated until the hooks 7 engage slots 8, and the cantilever body 2 is shifted downwardly as described above. Cantilever body 2 is then rotated slightly in the opposite direction, shifting extension 51 into a position abutting the upper edge of slot 8 to prevent dislodgement. The mounting plate 10 is then connected to the cantilever body 2 in the desired position by inserting the selected hook 18, 22 or 24 into the opening 44 of the cantilever body 2. As discussed above, the hook is inserted with the forward portion 31 of the mounting plate 10 raised slightly to provide clearance for the tab 45 of the hook. The mounting plate 10 is then rotated downwardly to engage the selected slot 17, 21, 23 or 26 on the tab 32 of the cantilever body 2. As discussed above, the mounting plate 10 may be installed on the cantilever body 2 in a first offset position 11 (FIG. 4), one of two center positions 13 (FIGS. 5 and 6), or a second offset position 12 (FIG. 7). After installing the mounting plate 10 on the cantilever body 2 in the desired position, the worksurface or worksurfaces 20 are secured to the mounting plate 10 using fasteners 34. A worksurface 20 is then secured to the cantilever body 2 using a fastener 57.

The multi-position bracket 1 of the present invention can be used as either a left-hand, right-hand, or center support bracket, thereby eliminating the need to fabricate multiple brackets specifically designed for each configuration. Furthermore, the multi-position bracket 1 of the present invention is easily fabricated and installed, thereby reducing the associated expenses.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A multi-position bracket for supporting hang-on furniture units on a slotted upright, comprising:

a cantilever body formed from sheet metal, said cantilever body defining first and second sides, and including rear and upper orthogonal edges, said rear edge including at least one support hook, said cantilever body including a first connector;

a mounting plate interconnected with said cantilever body in a selected one of first and second offset positions and a center position relative to said cantilever body; said mounting plate defining a center portion and first and second opposite side portions;

said center portion including a center connector interconnecting said mounting plate and said first connector of said cantilever body with said mounting plate located in said center position for supporting adjacent side edges of a pair of side-by-side hang-on furniture units;

said first side portion including a connector for interconnecting said mounting plate and said first connector of said cantilever body when said mounting plate is shifted from said center position to a laterally offset position relative to said first side of said cantilever body for supporting a side edge of a hang-on furniture unit disposed on said first side of said cantilever body; and said second side portion including a connector for interconnecting said mounting plate and said first connector of said cantilever body when said mounting plate is shifted from said center position to a laterally offset position relative to said second side of said cantilever body for supporting a side edge of a hang-on furniture unit disposed on said second side of said cantilever body.

2. A multi-position bracket as set forth in claim 1, wherein: said center portion of said mounting plate includes a hook engaging said cantilever body.

3. A multi-position bracket as set forth in claim 2, wherein: said cantilever body includes a slot that receives said hook of said mounting plate.

4. A multi-position bracket as set forth in claim 3, wherein:

said cantilever body includes a support flange adjacent said upper edge, said flange defining an upper surface shaped to fit closely against a lower surface of a hang-on furniture unit, said flange having a clearance hole therethrough for receiving a fastener to secure said cantilever body to a hang-on furniture unit.

5. A multi-position bracket for supporting hang-on furniture units on a slotted upright, wherein:

a cantilever body defining first and second sides, and including rear and upper orthogonal edges, said rear edge including at least one support hook;

a mounting plate interconnected with said cantilever body in a selected one of first and second offset positions and a center position relative to said cantilever body; said mounting plate defining a center portion and first and second opposite side portions;

said center portion including a center connector interconnecting said mounting plate and said cantilever body with said mounting plate in said center position for supporting adjacent side edges of a pair of side-by-side hang-on furniture units;

said first side portion including a connector for interconnecting said mounting plate and said cantilever body with said mounting plate offset to said first side of said cantilever body for supporting a side edge of a hang-on furniture unit disposed on said first side of said cantilever body;

said second side portion including a connector for releasably interconnecting said mounting plate and said cantilever body when said mounting plate is offset to said second side of said cantilever body for supporting a side edge of a hang-on furniture unit disposed on said second side of said cantilever body;

said center portion of said mounting plate including a hook engaging said cantilever body;

said cantilever body including a slot that receives said hook of said mounting plate;

said cantilever body including a support flange adjacent said upper edge, said flange defining an upper surface shaped to fit closely against a lower surface of a hang-on furniture unit, said flange having a clearance hole therethrough for receiving a fastener to secure said cantilever body to a hang-on furniture unit;

said center connector of said mounting plate including at least one opening therethrough; and said cantilever body including a tab adjacent said upper edge, said tab engaging said at least one opening in said mounting plate.

6. A multi-position bracket as set forth in claim 5, wherein:

said mounting plate defines a forward portion and a rear portion, said at least one opening in said mounting plate is located adjacent said forward portion.

7. A multi-position bracket as set forth in claim 6, wherein:

said hook of said mounting plate is located adjacent said rear portion of said mounting plate.

8. A multi-position bracket as set forth in claim 7, wherein:

said connector of said first and second side portions of said mounting plate each include a slot for receiving said tab of said cantilever body; and said first and second side portions each include a hook for engaging said slot in said cantilever body.

9. A multi-position bracket as set forth in claim 8, wherein:

said mounting plate is formed from sheet metal, said hooks of said mounting plate defined by an orthogonal, downwardly-extending flange portion defining a rear edge of said mounting plate.

10. A multi-position bracket for supporting hang-on furniture units on a slotted upright, comprising:

a cantilever body defining first and second sides, and including rear and upper orthogonal edges, said rear edge including at least one support hook;

a mounting plate interconnected with said cantilever body in a selected one of first and second offset positions and a center position relative to said cantilever body; said mounting plate defining a center portion and first and second opposite side portions;

said center portion including a center connector interconnecting said mounting plate and said cantilever body with said mounting plate in said center position for supporting adjacent side edges of a pair of side-by-side hang-on furniture units;

said first side portion including a connector for interconnecting said mounting plate and said cantilever body with said mounting plate offset to said first side of said cantilever body for supporting a side edge of a hang-on furniture unit disposed on said first side of said cantilever body;

said second side portion including a connector for interconnecting said mounting plate and said cantilever body when said mounting plate is offset to said second side of said cantilever body for supporting a side edge of a hang-on furniture unit disposed on said second side of said cantilever body;

said at least one support hook of said cantilever body having an upper extension for abutting an upper edge of one of said slots when in an installed position on the upright, said extension for preventing upward shifting and accidental dislodgement of said cantilever body from the upright; and said mounting plate having a rear portion for abutting the upright and preventing inward shifting of said cantilever body relative to the upright to a position wherein said extension is offset from the upper edge of the one of the slots, said mounting plate thereby preventing removal of said cantilever body from said upright.

11. A kit comprising:

at least one worksurface;

a multi-position bracket for supporting said at least one worksurface, said bracket including:

a cantilever body defining opposite sides and including rear and upper orthogonal edges;

a mounting plate configured to be secured to said at least one worksurface and including at least two connectors adapted to interconnect said mounting plate with said cantilever body, a first one of said at least two connectors adapted to connect said mounting plate to said cantilever body with said mounting plate in a center position for supporting adjacent side edges of a pair of side-by-side ones of said worksurfaces;

a second one of said at least two connectors adapted to interconnect said mounting plate with said cantilever body such that said mounting plate is offset to a selected opposite side of said cantilever body for supporting a side edge of said at least one worksurface;

said first one of said at least two connectors of said mounting plate including a slot in a center portion of said mounting plate; and said cantilever body including a tab adapted to engage said slot to interconnect said mounting plate with said cantilever body in said center position.

12. A kit as set forth in claim 11, wherein:

said center portion of said mounting plate includes a second slot therethrough adapted to engage said tab to interconnect said mounting plate with said cantilever body in said center position.

13. A kit as set forth in claim 12 wherein:

said rear edge of said cantilever body includes at least one hook shaped to removably engage slots of an upright.

14. A kit as set forth in claim 13 wherein:

said mounting plate includes first and second side portions, each of which includes corresponding second ones of said at least two connectors, each of said second ones of said at least two connectors comprising a slot adapted to engage said tab with said mounting plate offset to a selected one of said opposite sides of said cantilever body.

15. A kit as set forth in claim 14 wherein:

said cantilever body includes a slot;

said mounting plate has a rear portion defining three downwardly-extending hooks, including a center hook and a pair of side hooks;

said side hooks adapted to engage said slot with said mounting plate offset to a selected one of said opposite sides of said cantilever body; and said center hook adapted to engage said slot of said cantilever body with said mounting plate in said center position.

16. A kit as set forth in claim 15 wherein:

said worksurface defines a lower surface;

said cantilever body includes a support flange adjacent said upper edge, said flange defining an upper surface adapted to fit closely against said lower surface of said worksurface, said flange having a clearance hole therethrough; and including:

a fastener extending through said clearance hole and securing said cantilever body to said worksurface.

17. A kit as set forth in claim 16 wherein:

said cantilever body is sheet metal defining a lower edge having a convexly-curved portion and a concavely-curved portion.

18. A kit, comprising:

at least one worksurface;

a multi-position bracket for supporting said at least one worksurface, said bracket including:

a metal cantilever body defining opposite sides and including rear and upper orthogonal edges;

a mounting plate configured to be secured to said at least one worksurface and including at least two connectors adapted to interconnect said mounting plate with said cantilever body, a first one of said at least two connectors adapted to connect said mounting plate to said cantilever body with said mounting plate in a center position for supporting adjacent side edges of a pair of side-by-side ones of said worksurfaces;

a second one of said at least two connectors adapted to interconnect said mounting plate with said cantilever body such that said mounting plate is offset to a selected opposite side of said cantilever body for supporting a side edge of said at least one worksurface; and wherein:

said cantilever body includes a slot;

said mounting plate has a rear portion defining three downwardly-extending hooks, including a center hook and a pair of side hooks;

said side hooks adapted to engage said slot with said mounting plate offset to a selected one of said opposite sides of said cantilever body; and said center hook adapted to engage said slot with said mounting plate in said center position.

19. A kit as set forth in claim 18 wherein:

said mounting plate is formed from sheet metal, with said hooks being defined by an orthogonal, downwardly-extending flange portion defining a rear edge of said mounting plate.

20. A combination of a mounting plate and a cantilever body for hang-on furniture units, comprising:

said cantilever body having a tab and an opening, said cantilever body including at least two vertically aligned hooks for engaging a vertical row of openings in a slotted upright;

said mounting plate having at least three side-by-side apertures adjacent a front portion of said mounting plate, each aperture engagable with said tab of said cantilever body to permit support of said front portion of said mounting plate in a selected one of three positions corresponding to said apertures; and said mounting plate having at least three hooks adjacent a rear portion of said mounting plate, each hook engagable with said opening of said cantilever body to permit support of said rear portion of said mounting plate in a selected one of the three positions corresponding to said hooks.

21. A combination mounting plate and cantilever body as set forth in claim 20, wherein:

said mounting plate is formed from sheet metal, said hooks of said mounting plate defined by an orthogonal, downwardly-extending flange portion defining a rear edge of said mounting plate.

22. A combination of a mounting plate and a cantilever body as set forth in claim 21, wherein:

said mounting plate includes a fourth aperture, the fourth aperture and said at least three apertures forming four side-by-side apertures adjacent said front portion of said plate, each aperture engagable with the tab of the cantilever body to permit support of said front portion of said mounting plate in a selected one of four positions corresponding to said four side-by-side apertures.

23. A multi-position bracket for supporting hang-on furniture units on a slotted upright, comprising:

a cantilever body formed from sheet metal, said cantilever body defining first and second sides, and including rear and upper orthogonal edges, said rear edge including at least one support hook;

a mounting member releasably interconnected with said cantilever body in a selected one of first and second offset positions and a center position relative to said cantilever body; said mounting member defining a center portion and first and second opposite side portions;

said center portion including a center connector releasably interconnecting said mounting member and said cantilever body with said mounting member located in said center position relative to said cantilever body for supporting adjacent side edges of a pair of side-by-side hang-on furniture units, said center connector configured to permit toolless manual interconnection between said cantilever body and said mounting member;

said first side portion including a connector for releasably interconnecting said mounting member and said cantilever body when said mounting member is shifted from said center position to a laterally offset position relative to said first side of said cantilever body for supporting a side edge of a hang-on furniture unit disposed on said first side of said cantilever body; and said second side portion including a connector for releasably interconnecting said mounting member and said cantilever body when said mounting member is shifted from said center position to a laterally offset position relative to said second side of said cantilever body for supporting a side edge of a hang-on furniture unit disposed on said second side of said cantilever body.

24. A kit, comprising:

a first worksurface defining a first side edge;

a second worksurface defining a second side edge having a shape that is complementary of said first side edge to permit close positioning in a side-by-side configuration therewith substantially without gaps between said first and second worksurfaces;

a cantilever body formed from sheet metal, said cantilever body including at least one support hook adapted to support said cantilever from an opening in an associated upright member, said cantilever body including an upper edge having a first connector part thereon;

a mounting member defining a central portion and first and second opposite side portions, said central portion having a central connector, said first opposite side portion having a first side connector, said second opposite side portion having a second side connector, each said connector adapted to engage said first connector part of said cantilever body, such that said mounting member supports said first and second worksurfaces in said side-by-side configuration when said central connector engages said first connector part, said mounting member supporting said first worksurface offset to a first side of said cantilever body when said first side connector engages said first connector part, and said mounting member supporting said second worksurface offset to a second side of said cantilever body when said second side connector engages said first connector part, such that said cantilever body and said mounting member can be configured to support said first worksurface, said second worksurface, or both worksurfaces.

25. A kit, comprising:

a first worksurface defining a first side edge;

a second worksurface defining a second side edge having a shape that is complementary of said first side edge to permit close positioning in a side-by-side configuration therewith substantially without gaps between said first and second worksurfaces;

a cantilever body including at least one support hook adapted to support said cantilever from an opening in an associated upright member, said cantilever body including, an upper edge having a first connector part thereon;

a mounting member defining a central portion and first and second opposite side portions, said central portion having a central connector, said first opposite side portion having a first side connector, said second opposite side portion having a second side connector, each said connector adapted to engage said first connector part of said cantilever body, such that said mounting member supports said first and second worksurfaces in said side-by-side configuration when said central connector engages said first connector part, said mounting member supporting said first worksurface offset to a first side of said cantilever body when said first side connector engages said first connector part, and said mounting member supporting said second worksurface offset to a second side of said cantilever body when said second side connector engages said first connector part such that said cantilever body and said mounting member can be configured to support said first worksurface, said second worksurface, or both worksurfaces, including:

a threaded fastener for securing said mounting member to a selected one of said first and second worksurfaces.

26. The kit set forth in claim 24 wherein:

said central, first side, and second side connectors each have substantially the same shape; and said mounting member includes structure for connecting said mounting member to at least a selected one of said first and second worksurfaces, said structure having a shape that is different than that of said central, first side, and second side connectors.

* * * * *

UNITED STATES PATENT AND TRADEMARK OFFICE

CERTIFICATE OF CORRECTION

PATENT NO. : 6,202,966 B1 
DATED : March 20, 2001
INVENTOR(S) : Douglas B. MacDonald et al.

It is certified that error appears in the above-identified patent and that said Letters Patent is hereby corrected as shown below:

Column 8,
Line 5, "with said mounting plate offset" should be -- when said mounting plate is offset --.

Signed and Sealed this

Eleventh Day of March, 2003

JAMES E. ROGAN
*Director of the United States Patent and Trademark Office*